United States Patent [19]

Chatourel

[11] 3,983,852

[45] Oct. 5, 1976

[54] INTERNAL COMBUSTION ENGINE DISPOSITION

[75] Inventor: Pierre Chatourel, Boulogne-Billancourt, France

[73] Assignees: Regie Nationale des Usines Renault; Automobiles Peugeot, both of Paris, France

[22] Filed: Jan. 15, 1975

[21] Appl. No.: 541,349

[30] Foreign Application Priority Data

Jan. 16, 1974 France ..... 74.01376

[52] U.S. Cl. ..... 123/41.69; 123/41.31; 123/41.52; 123/41.82 R; 123/195 C; 123/195 R

[51] Int. Cl.[2] ..... F02F 1/30

[58] Field of Search ..... 123/195 R, 195 C, 41.69, 123/41.52, 41.31, 41.32, 41.82

[56] References Cited

UNITED STATES PATENTS

| | | | |
|---|---|---|---|
| 1,044,065 | 11/1912 | Luce | 123/41.52 |
| 2,070,588 | 2/1937 | Geisse | 123/41.52 |
| 2,184,820 | 12/1939 | Tucker | 123/41.69 |
| 2,362,622 | 11/1944 | Fischer | 123/41.69 |
| 2,584,289 | 2/1952 | Rabe | 123/41.69 |
| 3,166,053 | 1/1965 | Fischer | 123/41.69 |
| 3,181,515 | 5/1965 | Zurich | 123/41.69 |
| 3,650,250 | 3/1972 | Lohr | 123/41.69 |
| 3,782,344 | 1/1974 | Schmuck | 123/41.69 |
| 3,841,278 | 10/1974 | Frehe | 123/41.69 |

*Primary Examiner*—Charles J. Myhre
*Assistant Examiner*—Daniel J. O'Connor
*Attorney, Agent, or Firm*—Fleit & Jacobson

[57] ABSTRACT

Internal combustion engine structure comprising a one-piece cylinder-block and crankcase casting with integral cylinder-head, of light alloy, and incorporating valve guides, induction ports, exhaust ports, spark plug wells, cooling-water chambers open at the upper portion of the casting around the valve seatings and closed by a cover, said cooling-water chambers extending axially around the cylinders and outside the areas corresponding to the induction and exhaust ports and also to the spark-plug wells, said casting further comprising in said areas around said cylinders a wall portion provided with cooling fins, whereby the casting can be obtained directly from a light alloy in a chill-mould, notably according to the known high-pressure casting process.

6 Claims, 7 Drawing Figures

Fig- 4
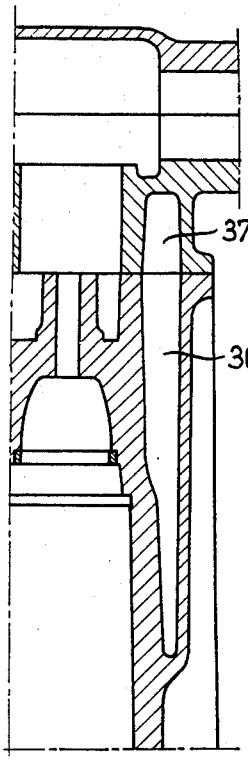
Fig- 3
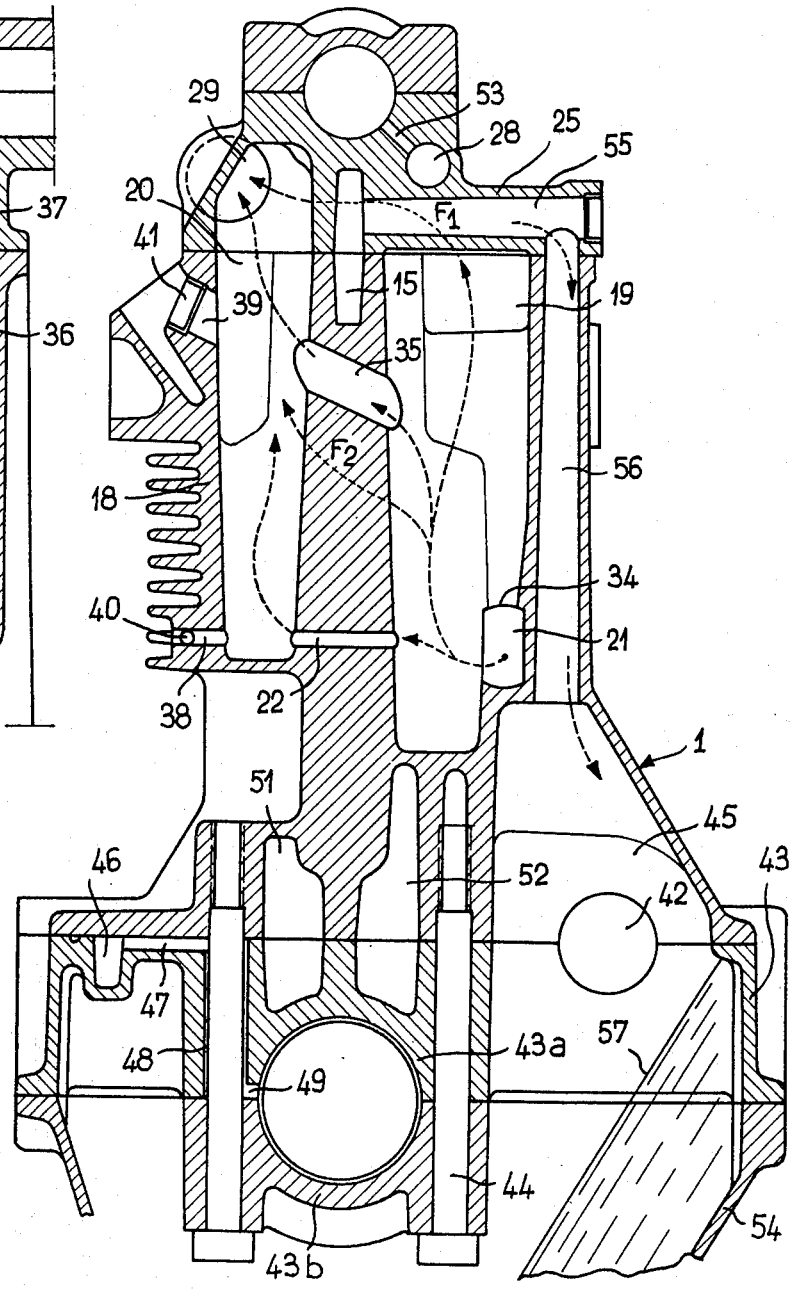
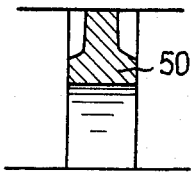
Fig- 5

INTERNAL COMBUSTION ENGINE DISPOSITION

The present invention relates to an internal combustion engine disposition or structure, the engine being basically of the piston and water-cooled or fluid-cooled type. Obviously, the construction of internal combustion engines with in-line pistons and a water-cooling system has been centered, as far as medium-size engines such as motor vehicles engines are concerned, on the well-known arrangement comprising an assembly of two main components: the cylinder block and the cylinder head. For these two basic components the most usual material is either cast-iron or aluminium. If a cast-iron cylinder block is used, the cylinder-head consists generally of aluminium, for it is generally endeavoured to take advantage of one of the chief properties of aluminium, namely a good thermal conductivity. In addition, an aluminium cylinder-head reduces appreciably the weight of the engine unit. To further reduce this weight, some manufacturers use cast aluminium cylinder-blocks and crankcases, but in this case cast-iron cylinder liners must be fitted. This fitting operation is performed either when casting the block or as a subsequent assembling operation. Engines are also known wherein the cylinder-block and crankcase structure is cast from high-silicon aluminium so that the use of cast-iron cylinder liners can be dispensed with. In fact, this alloy has advantageous frictional properties in the hot state, provided that aluminium pistons coated with an iron film are used. Such engines can be cast under very high pressures for the metal cores necessary for casting the cylinders and the water passages can be stripped through the aperture of the cylinder-head assembling plane. Engines having a cylinder-head formed integrally with the cylinder-block and crankcase structure have also been manufactured. However these blocks, whether of cast-iron or aluminium with cast-in cylinder liners, are cast necessarily in sand moulds. In fact, the rather elaborate shapes of the cooling circuits around the cylinders and the induction and exhaust pipes or ports, which circuits constitute as a rule closed spaces, cannot be obtained unless sand cores adapted to be destroyed by stripping are used. Now, the mass production of these components requires huge foundry equipments, and also the use and preparation of a great number of sand cores. Besides, with this method it is not possible to obtain rough-cast holes, and the dimensional tolerances are not quite satisfactory and therefore require additional machining steps. In view of the foregoing, it appears that in the first case the necessity of assembling the cylinder-block and crankcase with the cylinder-head, with the interposition of a gasket and the use of fastening studs, and in the second case the necessity of casting a one-piece structure in a sand mould, lead to relatively high manufacturing costs and that these costs are extremely difficult to cut.

It is therefore the chief object of the present invention to avoid the inconveniences set forth hereinabove by providing an engine structure, notably of high-silicon aluminium, which affords substantial savings in foundry work, machining and assembling process, and constitutes a relatively light block having a high degree of efficiency.

To this end, the present invention consists essentially in providing an internal combustion engine structure comprising a one-piece cylinder-block and crankcase casting with integral cylinder-head, made of light alloy, incorporating valve guides, induction ports, exhaust ports, spark-plug wells, cooling-water chambers opening at the upper portion of the casting around the valve seatings and closed by a cover, said chambers extending in the axial direction around the cylinders and outside the areas corresponding to the induction and exhaust-ports and also to the spark-plug wells, this structure being further characterised in that said one-piece casting comprises in said areas around the cylinders a wall portion provided with cooling fins, whereby the casting can be obtained directly from a light alloy in a chill-mould, notably according to the known high-pressure casting process.

It will readily occur to those conversant with the art that this structure lends itself to the obtaining of chamber shapes that can be predetermined with a view to afford an easy casting thereof by direct stripping of metal cores, according to mass-production methods, for example in gravity-fed chill-moulds, low-pressure foundry procedures and, preferably, the above-mentioned high-pressure casting process. The function of the cooling fins is mainly to transfer combustion heat spreading in the aluminium at the location to be cooled towards chambers in which cooling water or other fluid circulates. As a secondary action these fins also diffuse the heat to the surrounding atmosphere as in conventional air-cooled engines. The use of high-silicon aluminium is in this case particularly advantageous due to its high heat conductivity.

Other features and advantages of this invention will appear as the following description of a few forms of embodiment thereof proceeds with reference to the accompanying drawings, in which:

FIG. 3 is another cross section taken between two adjacent cylinders and through the crankshaft bearings; in this Figure, the lower portion comprising the crankshaft bearings constitutes an insert or complementary element according to the French Pat. No. 2,200,894;

FIG. 4 is a longitudinal section taken along the vertical axis of an end cylinder;

FIG. 5 illustrates in longitudinal section the shape of one of the crankshaft bearings in the lower crankcase incorporated in the engine structure of FIG. 3;

Figure 6:
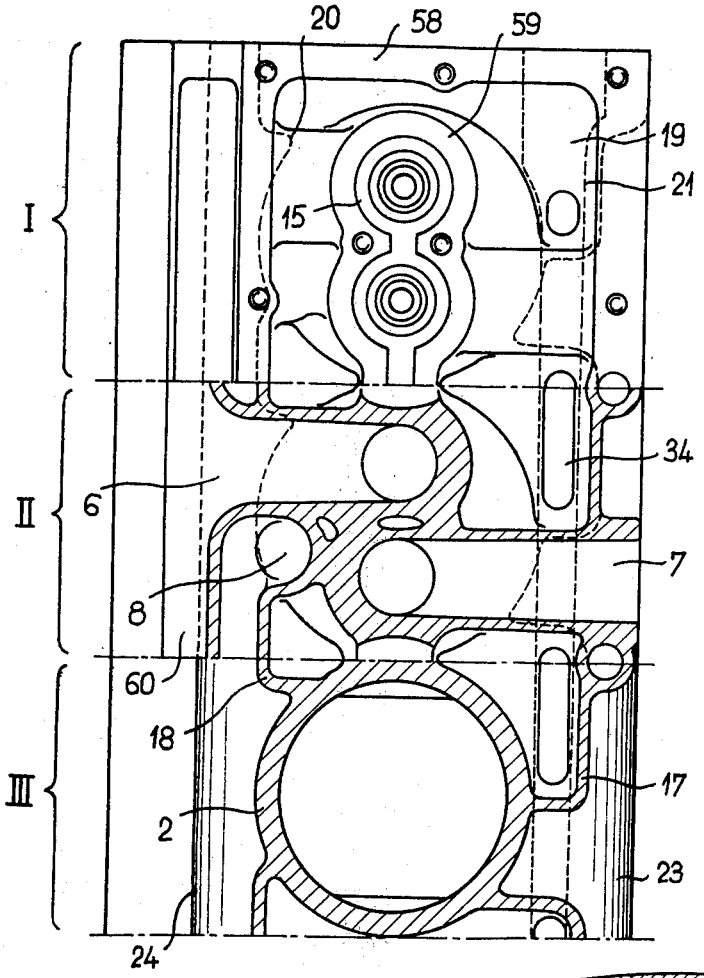
Figure 7:
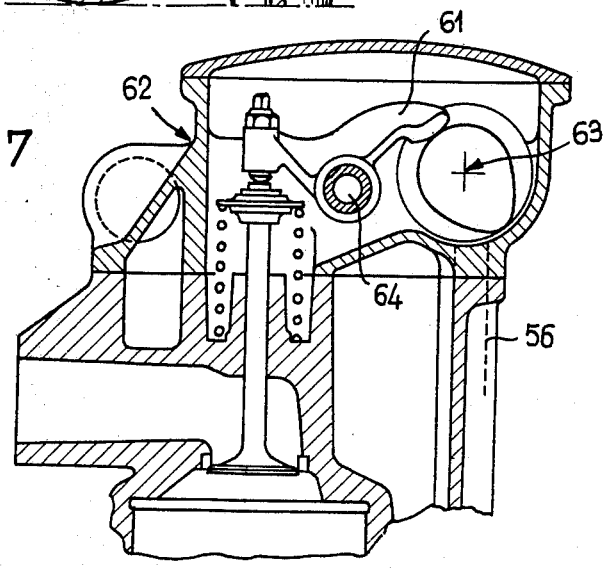

FIG. 6 illustrates in plane view from above the one-piece or block engine of which a first portion I is shown as such, a second portion II being shown in horizontal section taken at the level of the induction and exhaust pipes or ports, a third portion III being shown in horizontal section taken across a cylinder at the level of the aforesaid cooling fins, and FIG. 7 is a modified form of embodiment of the preceding structure showing in cross section the top cover with a rocker-type valve gear.

Figure 1:
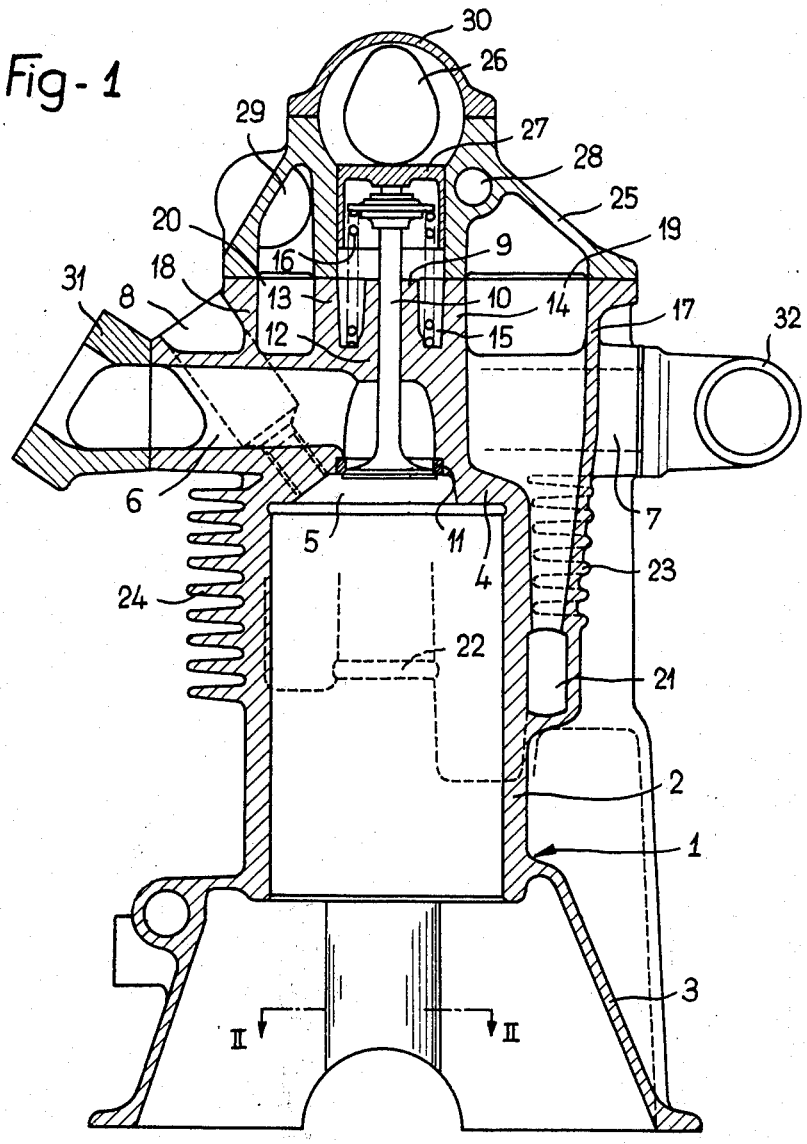
FIG. 1 is a vertical section taken along the axis of a cylinder of a one-piece or cylinder-block and crankcase casting, with associated top cover, camshaft and valve tappets.

The one-piece cylinder and crankcase casting illustrated in FIG. 1 comprises cylinders 2 disposed in line and longitudinally above the crankcase portion 3. These cylinders 2 are closed at their upper end by cylinder bottoms 4 defining combustion chambers 5, induction ports 6, exhaust ports 7 and spark-plug wells 8. Longitudinally and parallel to each cylinder axis a pair of bosses 9 are provided in which valve-seat forming passages 10 are formed. In this structure, the conventional valve-guide inserts can be dispensed with since high-silicon aluminium has excellent frictional properties in the hot state. Valve seats 11 are easily fitted from within the cylinders 2 after the machining thereof. A horizontal partition 12 and two vertical walls 13 and 14 interconnected at the end of the casting provide a channel 15 necessary for collecting the lubricating oil from the valve gear. The bottom of this channel 15 constitutes, at the base of said bosses 9, the bearing surface for the valve springs 16.

Lateral walls 17 and 18 also interconnected at the casting end and having their upper edges level with the upper edges of walls 13 and 14 provide chambers 19 and 20 adapted to be filled with cooling water or like fluid. These chambers 19 and 20 extend down to about one-half of the cylinder height and communicate with a cooling-fluid distributing manifold or header 21, the two chambers 19 and 20 communicating with each other through holes 22 drilled during the casting machining operations.

Below the ports 6 and 7 and the spark-plug well 8 the water chambers cannot be cast integrally in a chill-mould; therefore, these water chambers are replaced in this construction by a plurality of fins 23 and 24 connecting the walls of cylinders 2 to the outer walls 17 and 18 forming the cooling-fluid chambers.

Thus, as already explained in the foregoing, the heat developed in said cylinders 2 is transferred to said chambers 19 and 20 and also to the surrounding atmosphere.

The upper openings of chambers 15, 19 and 20 of this one-piece casting 1 are sealed by means of a single or common cover 25 constituting at the same time the support of an overhead camshaft 26. In addition to the bearing of this camshaft the cover 25 comprises bores for receiving the valve tappets 27, a passage 28 for lubricating oil under pressure and a pipe or port 29 for returning the cooling water to the radiator.

It will also be seen in FIG. 1 that another insert consists of a top cover 30 for the camshaft, one-half of an induction manifold 31, and an exhaust manifold 32.

The camshaft supporting cover 25, the top cover 30 and the half-manifold 31 are advantageously cast in a high-pressure chill-mould from common aluminium.

Figure 2:
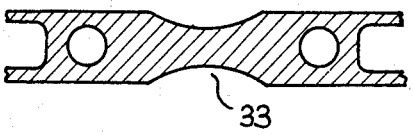
FIG. 2 is a detail showing in horizontal section as seen from above the configuration of the crankshaft half-bearings.

To permit the convenient stripping of the metal cores forming the cylinders 2 and reduce the over-all length of the engine, the intermediate crankshaft bearings comprise cavities 33 as shown in FIG. 2.

FIG. 3 illustrates more in detail the path followed by the cooling water or like fluid in the longitudinal and transverse directions within the one-piece casting.

This cooling fluid forced by a pump (not shown) into the longitudinal header or manifold 21 is distributed to said chambers 19 via orifices 34. From these chambers 19 it flows into chambers 20 via holes 22 and 35 drilled between the cylinders. Furthermore, this fluid flows along the path shown by the arrows $F_1$ and $F_2$ via cavities 36 and 37 provided at the two ends of the casting, as shown in FIG. 4. This fluid is finally discharged to the radiator (not shown) via the outlet port 29.

The holes 22 and 35 may be drilled through the wall 18 through holes 38 and 39 which are subsequently sealed, for example by means of a ball 40 or a cup-shaped plug 41.

FIG. 3 illustrates a typical application, in an engine of this type, of the French patent application No. 73/36358, disclosing a crankshaft lubricating system and the disposition of a secondary shaft 42 for balancing or driving other engine components or members. In this example, the one-piece casting 1 is bounded at its lower portion by a horizontal plane containing the axis of this secondary shaft 42. A crankcase element 43 holding the upper bearing halves of the crankshaft **43*a* is secured to said one-piece crankcase and cylinder casting by means of the bolts 44 assembling the crankshaft bearing caps 43*b*. The chief advantage of this disposition, in the case of a chill-mould mass-production, resides in the great facility of obtaining the cavities 45 necessary for the movements of shaft 42, in creating by simple rough casting the crankshaft lubricating circuit comprising the passages 46, 47, 48 and 49, in permitting the obtaining of bearings of constant width in the area designated by the reference numeral 50, as shown in FIG. 5, thus avoiding the inconvenience of the cavities 33 shown in FIG. 2. Furthermore, this arrangement reduces the weight of the assembly by providing cavities 51 and 52.**

The valve gear lubricating circuit is also obtained directly, at least as far as the main part thereof is concerned, by the disposition illustrated in FIG. 3. The pressure oil passage 28 may easily be connected to the lubricating header 46 via a series of rough-cast holes (not shown in the drawings) located at one end of the one-piece casting 1 and the camshaft case 25. The camshaft bearings are then connected to the pressure oil passage 28 via holes 53 drilled through the bearings. The oil is finally collected in channel 15 and discharged into the underlying oil sump 54 via passages 55 and 56.

This engine may advantageously be mounted in an inclined position, for example at an angle of up to 60° to the vertical, in order to facilitate the draining off of lubricating oil. The horizontal level of the sump oil is then located as shown at 57 in FIG. 3.

In FIG. 6 given to facilitate the understanding of the above explanations, the plan view from above I illustrates the joint planes 58 and 59 providing the internal and external fluid-tightness between the one-piece cylinder and crankshaft casting 1 and the cam shaft casing 25 of FIG. 1. More particularly, the gasket joint 58 provides the external fluid-tightness and the other gasket joint 59 separates the water chambers 19 and 20 from the oil channel 15.

The section 11 taken at the level of the various ports 6 and shows more particularly the position of these ports and also that of the spark-plug well 8 and half induction manifold 60.

Another section III of FIG. 6 taken across the cylinders shows the manner in which the cylinder walls 2 are connected by the cooling fins 24 to the walls 17 and 18 of water chambers 19 and 20. This section also shows the header 21 and its orifices 34 for distributing the cooling water or like fluid.

FIG. 7 shows a modified form of embodiment in the case of an engine comprising a rocker-type valve gear system, wherein the one-piece cylinder and crankcase casting is covered by a head 62 supporting the camshaft 63 and rocker shafts 64. In this disposition the lubricating oil is delivered in the conventional manner via the rocker shafts 64 and collected directly by means of passages 56 formed in said one-piece casting, as explained in the preceding example.

Although specific forms of embodiment of this invention have been described hereinabove and illustrated in the accompanying drawings, it will readily occur to those skilled in the art that various modifications and changes may be brought thereto without departing from the scope of the invention as set forth in the appended claims.

What is claimed as new is:

1. Internal combustion engine structure comprising a one-piece cylinder-block and crankcase casting with integral cylinder-head, of light alloy, and incorporating valve guides, induction ports, exhaust ports, spark plug wells, cooling-water chambers open at the upper portion of the casting around the valve seatings and closed by a cover, said cooling-water chambers extending axially around the cylinders and outside the areas corresponding to the induction and exhaust ports and also to the spark-plug wells, said casting further comprising in said areas around said cylinders a wall portion provided with cooling fins.

2. Internal combustion engine structure according to claim 1, wherein said cooling-water chambers of said cylinder-block and crankcase casting communicate with a lower inlet header extending in said casting on one side of the cylinders, and that comunication passages are provided between said chambers and formed between the cylinders, by means of holes formed to this end through one of the side walls and adapted to be sealed by suitable plug means.

3. Internal combustion engine structure according to claim 1, wherein said cylinder-block and crankcase casting constitutes by itself one portion of the induction manifold in the form of a conduit extending across said induction ports.

4. Internal combustion engine structure according to claim 1, wherein the cylinder-block cover is adapted to support the camshaft and the valve gears, said cover being assembled to said cylinder-block and crankcase casting along a joint plane above which it comprises, around valve seatings complementary to those of said casting, water chambers communicating with other water chambers formed in said cylinder-block and crankcase casting and also with a water outlet port formed in said cover on the said side as same valve seatings.

5. Internal combustion engine structure according to claim 1, wherein said one-piece cylinder-block and crankshaft casting is made of high-silicon aluminium or light alloy.

6. Internal combustion engine structure comprising a one-piece cylinder-block and crankcase casting with integral cylinder-head, of light alloy, and incorporating value guides, induction ports, exhaust ports, spark plug wells, cooling-water chambers open at the upper portion of the casting around the valve seatings and closed by a cover, said cooling-water chambers extending axially around the cylinders and outside the areas corresponding to the induction and exhaust ports and also to the spark-plug wells, said casting further comprising in said areas around said cylinders a wall portion provided with cooling fins, and further comprising at the lower portion of said one-piece cylinder-block and crankcase casting, a complementary crankcase component for the upper half-bearings of the crankshaft, said crankcase component being secured to said cylinder-block by means of bolts also adapted to fasten in position the caps of said bearings, weight-reducing cavities being provided between said casting and said complementary crankcase component.

* * * * *